United States Patent [19]

Holmdal

[11] Patent Number: 4,779,364

[45] Date of Patent: Oct. 25, 1988

[54] DEVICE FOR A LOAD CARRYING UNIT

[76] Inventor: Ulf G. Holmdahl, Klintvägen 5, Ellös, Sweden, S-440 80

[21] Appl. No.: 79,773

[22] PCT Filed: Oct. 31, 1986

[86] PCT No.: PCT/SE86/00501

§ 371 Date: Jul. 1, 1987

§ 102(e) Date: Jul. 1, 1987

[87] PCT Pub. No.: WO87/02727

PCT Pub. Date: May 7, 1987

[30] Foreign Application Priority Data

Nov. 4, 1985 [SE] Sweden ..... 8505195
Jun. 4, 1986 [SE] Sweden ..... 8602536

[51] Int. Cl.[4] ..... E02F 3/76

[52] U.S. Cl. ..... 37/117.5; 414/695.8; 414/687

[58] Field of Search ..... 37/117.5, 103; 414/695.8, 685, 687, 723

[56] References Cited

U.S. PATENT DOCUMENTS 2,718,718 9/1955 Bartlett ..... 37/117.5
3,231,114 1/1966 Le Tourneau ..... 414/687
3,758,941 9/1973 Jackson et al. ..... 414/695.8
3,922,017 11/1975 Cobb ..... 37/103 X
4,199,033 4/1980 Gundy, Jr. ..... 37/117.5
4,540,332 9/1985 Nakashima et al. ..... 414/687

*Primary Examiner*—Eugene H. Eickholt
*Attorney, Agent, or Firm*—Holman & Stern

[57] ABSTRACT

Device (14) for a load carrying unit (12), intended to interconnect the load carrying unit (12) and a supporting member (10) for the load carrying unit (12), arranged to cause a rotary movement for the load carrying unit (12) in relation to the supporting member (10) in a first plane, and preferably also a pendulous motion in a second plane extending from the first plane. A member (36) is arranged turnable or rotatable in relation to the supporting member (10), suspending the load carrying unit (12), and also a preferably cylindrical disc shaped member (30), defining a first a contact plane directed towards the load carrying unit (12). The load carrying unit (12) is arranged with a contact member, defining a second contact surface directed towards the cylindrical member (30) and extending in a substantially parallel relationship. Two groups of bearing means (44, 46) are arranged in an intermediate position between said first and second contact surface, one group (46) being arranged to take up an adjustable contact against the first contact plane, and a second group (44) being arranged to take up an adjustable contact with the second contact plane.

14 Claims, 4 Drawing Sheets

10
16
22
26
20
18
18
22
40
24
30
14
32
42
36
38
34
38
46
12

DEVICE FOR A LOAD CARRYING UNIT

CROSS REFERENCE TO RELATED APPLICATION(S)

This U.S. application stems from PCT International Application No. PCT/SE86/00501 filed Oct. 31, 1986.

The present invention relates to a device for a load carrying unit, for example excavating machine buckets, wheel tractor buckets, load carrying forks for trucks and wheel tractors, and other similar units.

In existing types of load carrying units, it is often desirable to accomplish an improved maneuverability, and for example with regard to excavating machine buckets, such improved maneuverability can consist of the possibility to cause a rotary movement of the bucket in relation to the jib. Also with regard to other types of load carrying units, it is desirable to improve the freedom of movement, and for example, fork lift trucks utilized for transport of in direction upwards open containers can be mentioned, which in a simple manner may be emptied of its contents, provided that the supporting lift fork could perform a turning or rotary movement. Apart from such a turning or rotary movement, a pendulous motion in relation to the rotary plane is also obviously desired, thereby causing the material to be removed during an emptying operation to be released in a better manner.

A previously known device for accomplishing a rotary movement of an excavating machine bucket in relation to a supporting jib, and also a pendulous motion in relation to the rotary plane, is disclosed in SE, A, No. 438 882. However, this previously known device facilitates only a rather restricted rotary movement, and reduces the capacity of the bucket, and the supporting bearing used is rapidly worn down. Previous attempts made to attach a bucket to a shaft arranged with cogs, and maneuvered by means of a rack, have only resulted in deformation or breakage of the supporting shaft, caused by the forces imposed on the shaft during the work of the bucket.

The object of the present invention is to disclose a device facilitating maximum movement, both in the rotary plane and during a pendulous motion in relation to said plane. A further object is to disclose an improved supporting bearing, which can absorb the axial and transverse forces that occur, and also being arranged to facilitate adjustment for reduction of existing play, e.g. caused by wear.

The device according to the present invention is intended to belocated in an intermediate position between a load carrying unit and a supporting member for the load carrying unit, and it is arranged to impose a rotary movement for the load carrying unit in relation to the supporting member in a first plane, and preferably also a pendulation movement in a second plane extending from the first plane, and it is mainly characterised in that it includes a tubular or stud shaped member, arranged turnable or rotatable in relation to the supporting member, arranged to suspend the load carrying unit adjacent to a first end portion, and adjacent to a second end portion being joined to a preferably cylindrical and disc shaped member, having a surface directed towards the load carrying unit defining a first contact plane, the load carrying unit being arranged with a contact member, defining a second and towards the cylindrical member directed contact plane extending in a substantially parallel relationship, two groups of bearing means being arranged in an intermediate position between said first and second contact planes, one group being arranged to take up an adjustable contact position against the first contact plane, and the second group being arranged to take up an adjustable contact position against the second contact plane, and with a means being arranged to cause a preferably reversible rotary movement of the cylindrical disc shaped member, thereby rotating or turning the load carrying unit as desired in relation to the supporting member.

Examples of embodiments of a device according to the present invention, arranged at an excavating machine bucket, are more fully described below with reference to the accompanying drawings, in which.

Figure 1:
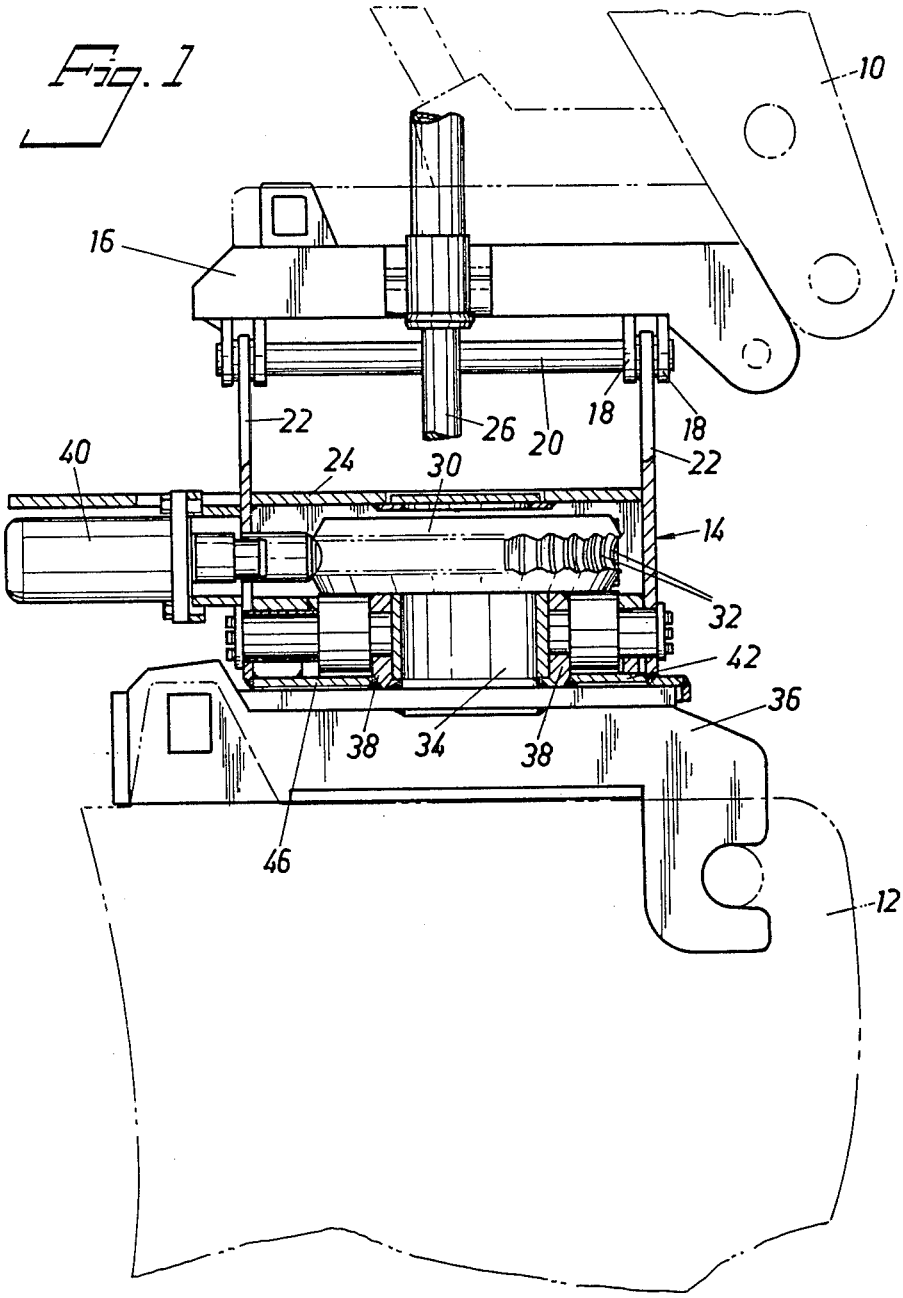
FIG. 1 is a schematical side view of an embodiment of a device according to the invention, arranged at a jib and supporting a bucket.

With reference to FIG. 1, a jib 10 of an excavating machine and an associated bucket 12 are shown in broken lines, the open portion of the bucket 12 being directed towards the left side in said figure. The device according to the invention, as a complete unit denominated 14, is arranged to facilitate attachment against the jib 10 in a conventional manner by means of an attachment member 16. The attachment member 16 forms a first part of the device 14, and includes two as pairs arranged supporting members 18, between which a shaft 20 extends. A second part of the device 14 comprises of two plate shaped members 22, separated from each other and pivotably attached to the shaft 20. The plate shaped members 22 are interconnected by means of a plate 24, extending in a transverse relationship to the plate shaped members 22. The portion of the second part of the device 14 extending from the plate 24 in direction away from the supporting shaft 20 is arranged as a housing, intended to protect the movable parts included in the device 14.

Figure 2:
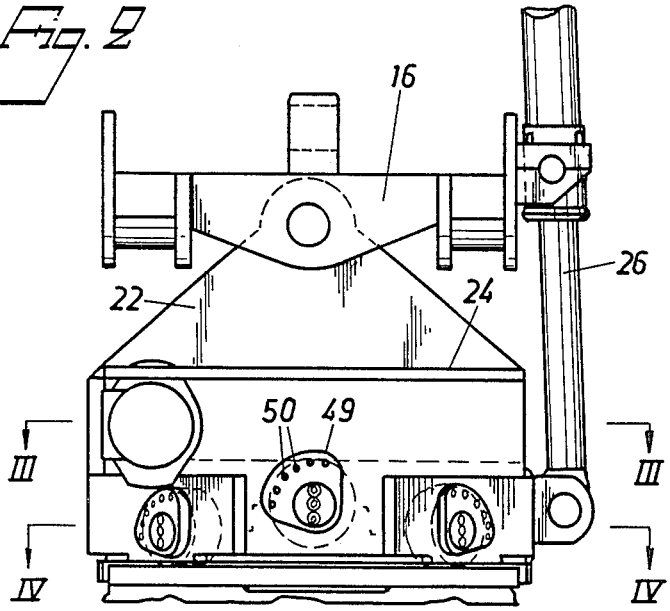
FIG. 2 is a side view of the the device shown in FIG. 1.

A piston cylinder 26, preferably hydraulically operated, is arranged extending between a first pivotable attachment point at the attachment member 16 and a second pivotable attachment point at the housing arranged by the plate shaped members 22, as shown more in detail in FIG. 2. By operating said piston cylinder 26, the bucket can be caused to perform a pendulous motion, when the second part of the device 14 is moved in relation to the first part.

Figure 3:
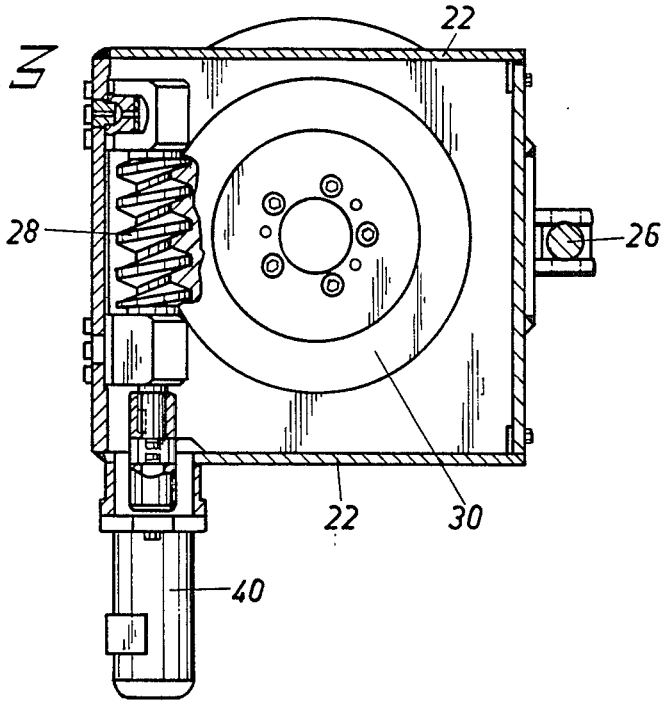
FIG. 3 is a cross-sectional view along the sectional line III—III in FIG. 2.

The device according to the present invention also facilitates a rotary movement of the bucket 12, and an example of how such a rotary movement can be accomplished is shown in FIGS. 1 and 3. For this purpose a screw worm 28 is used, arranged interconnected with a cog wheel 30, having peripherially arranged cogs 32 co-operating with the screw worm 28. The cog wheel 30 is attached by means of a screw or bolt attachment against a first end portion of a stud shaped member 34, the other end portion of same being joined to an attachment means 36 for the bucket 12. The stud shaped member 34 is arranged rotatable in relation to a surrounding tubular member 38, which is rigidly attached to the pivotable second part of the device 14. The screw worm 28 is also rotatably supported in this second part of the device, driven by means of a motor 40. By influencing the motor 40, the screw worm 28 can thus be caused to perform a rotary movement, and thereby also rotate the cog wheel 30, the stud shaped member 34, and the bucket 12. By influencing the rotary speed and the rotary direction of the motor 40, the bucket 12 can be rotated in alternate directions to any desired angle, and the rotary movement can be performed desired number of revolutions in desired direction, and with the rotary speed varied as desired.

Figure 4:
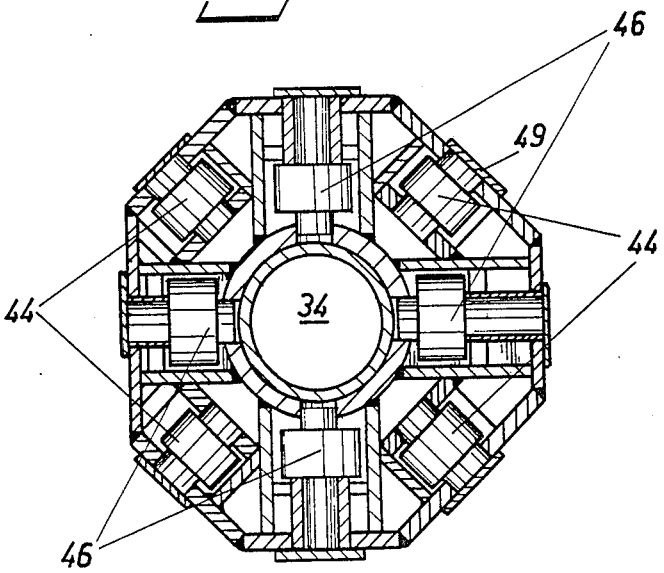
FIG. 4 is a cross-sectional view along the sectional line IV—IV in FIG. 2.

In order to absorb the forces and loads imposed during the work of the bucket 12, a number of roller shaped members 44, 46 are arranged in an intermediate position between a plate 48 at the attachment means 36, and the side plane of the cog wheel 30 facing said plate 48. With reference to the example of an embodiment shown in FIG. 4, four rollers 44 are utilized arranged in contact with the plate 48, and four rollers 46 are arranged in contact with the side plane of the cog wheel 30. The number of rollers can be varied, but the number of rollers in each contact group should not be less than three, whereas there is no objection to use of more than four rollers 44, 46 in each group, since an increased number substantially only results in advantages. As shown in FIGS. 1 and 4, a tubular bearing is also advantageously located intermediately between the stud shaped member 34 and surrounding tubular member 38, e.g. manufactured from bearing bronze, intended to reduce existing friction between the stud shaped member 34 and surrounding tubular member 38.

In order to accomplish favourable and complete contact between the rollers 44, 46 and associated plate 48 and cog wheel 30 respectively, adjustment means 49 are arranged, as shown more in detail in FIG. 2. According to this embodiment, the adjustment means 49 comprise of a substantially triangular plate, pivotably attached to a wall portion of the second part of the device 14, which in this embodiment is arranged as a multisided part at the outer portion directed towards the bucket 12, as shown in FIG. 4. The shafts that support the rollers 44, 46 at the adjustment means 49 are located slightly displaced in relation to the rotary center for the adjustment means 49 at the wall member. As a result, an excentric action is achived during a pivoting movement of the adjustment means 49, which results in that associated roller 44, 46 is moved against the plate 48, or the cog wheel 30. When suitable contact pressure is achieved, the adjustment means 49 is locked in the position taken up by insertion of a stud in suitable hole 50. The contact pressure is choosen on basis of the type of work to be performed. During the work, the rotary movement and the pendulous motion of the bucket 12 can be performed independently of each other, since the means for accomplishing said movements are individually operated. Furthermore, the attachment members 16, 36 facilitate rapid and conventional attachment of the device 14 against jibs 10 and buckets 12, The device 14 is further extremely compact and requires a minimum of space between the bucket 12 and the jib 10. Furthermore, the device 14 does not require any space within the bucket 12. The worm gear 28, 30, and the rollers 44, 46, are enclosed within a housing and are well protected against dirt and damage. Due to the excentric action for collating the rollers 44, 46, same are easily adjusted to compensate for existing play, and for absorbing and distributing over a large area yhe forces imposed on the device 14 during work. The method in which applied forces are distributed via the rollers 44, 46 against relatively large pressure absorbing surfaces also results in resistance for the device 14 against existing forces, as well as extremely good reliability in operation.

However, the embodiment shown and described can be further modified, either in view to make it suitable for other types of machines or load carrying units, or with regard to design solutions for included details. As examples of such modifications can be mentioned that the rollers 44, 46 obviously can be suspended in other types of adjustment means 49, which have excentric action, e.g. with the shafts of the rollers 44, 46 attached in an excentrically located hole arranged in a cylindrical washer member, which can be arranged rotatable in a surrounding cylindrical recess. Also the method in which the adjustment means 49 is locked in desired position can obviously be further varied, and for example lock screws, clamping joints and other solutions can be used. For certain applications may also the previously discussed pendulous motion be of little interest, in which case the members used to accomplish such a motion obviously can be excluded. The method in which a rotary movement is accomplished can also be further varied, and the motor 40 and the screw worm 28 can for instance be replaced by a hydraulically or pneumatically operated piston cylinder, attached to a rack interconnected with the cog wheel 30. The rotatable stud shaped member 34 can also advantageously be arranged as a tubular member, in order to reduce the total weight of the device 14.

Figure 5:
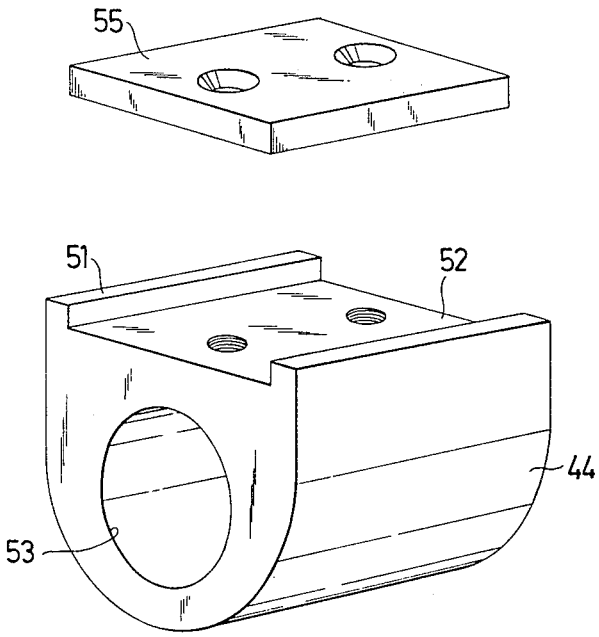
FIG. 5 is a perspective view of a bearing means, modified in relation to the bearing means shown in FIGS. 1 and 4, and with an associated wear member shown in a separated position.

The roller shaped members 44, 46, having a cylindrical cross-section, have only small contact areas acting against adjacent contact surfaces. As a result, both the roller shaped members 44, 46 and the contact surfaces require an extremely hard surface in order to avoid plastical deformation caused by existing pressure loads. However, the contact surface of each roller shaped member 44, 46 can be considerably enlarged by the modification disclosed in FIGS. 5 and 6.

Figure 6:
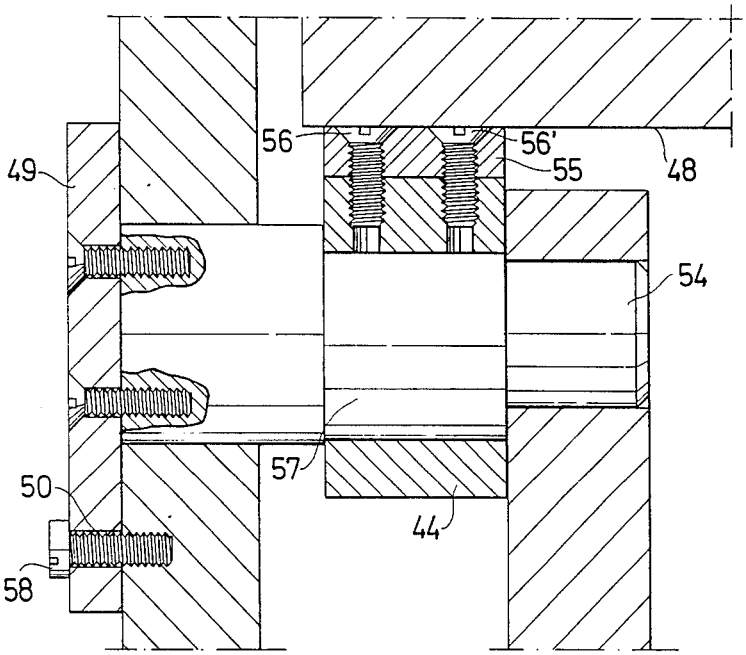
FIG. 6 is a cross-sectional view of the means shown in FIG. 5, arranged by a supporting shaft and in a contact position against an adjacently located contact plane.

According to this modified embodiment, each excentrically supported bearing means includes a supporting body 44, being located and supported correspondingly to the roller shaped members 44, 46 described with reference to the embodiment shown in FIGS. 1–4. However, this supporting body 44 is arranged with a plane surface 51, in which a groove 52 is arranged, extending in a direction corresponding to a through hole 53, into which a supporting shaft 54 is insertable. A wear member 55, insertable into the groove 52, is also shown, which when inserted is arranged having the edge surfaces embraced by the side portions of the groove 52. The wear member is attached and held within the groove by means of two screws 56, 56, as shown in FIG. 6.

The supporting body 44 is pivotally supported at an excentric portion 57 of the shaft 54, and the outer end portion of the shaft 54 is joined to an adjustment means 49, arranged with a number of holes 50, and as previously described with regard to the first embodiment, one of these holes is utilized to lock the adjustment means in desired position, e.g. by inserting a screw 58, stud or similar means.

This modified bearing means results in an enlarged contact area between the bearing means and associated contact surface. The use a wear member 55 is advantageous, since same can be replaced when worn, but is is also obviously possible to exclude the wear member 55 and associated groove 52, and to use a contact surface arranged integrated with the supporting body 44, i.e. with the plane 51 arranged as a uniterrupted surface.

The use of a groove 52 in connection with a demountable wear member 55, arranged to seize or embrace at least two opposed edge portions of the wear member 55, causes the forces applied in use to the wear member 55 to be taken up in a better way. However, it is obviously also possible to exclude said groove 52, provided that the wear member 55 is attached in such a fashion that applied forces are taken up. As an example of such a modification can be mentioned the possibility to arrange the wear member 55 having a width exceeding the width of the supporting body 44, and with a groove arranged at the surface intended to abut the supporting body 44, whereby the side portions of the groove taken up in the wear member 55 are arranged embracing the edge portions of the supporting body 44.

The present invention is thus in no way restricted to the embodiment shown and described, since it can be further modified within the scope of the inventive thought and the following claims.

I claim:

1. Device for a load carrying unit, intended to be located in an intermediate position between the load carrying unit and a supporting member for the load carrying unit, arranged to impose a rotary movement on the load carrying unit in a first plane, and preferably also a pendulous motion in a second plane extending from the first plane, characterised in, that it includes a tubular or stud shaped member, arranged turnable or rotable in relation to the supporting member, arranged to suspend the load carrying unit adjacent to a first end portion, and adjacent to a second end portion being joined to a preferably cylindrical and disc shaped member, having a surface directed towards the load unit defining a first contact plane, the load carrying unit being arranged with a contact member, defining a second and towards the cylindrical member directed contact plane extending in a substantially parallel relationship, two groups of bearing means being arranged in an intermediate position between said first and second contact planes, one group being arranged to take up an adjustable contact position against the first contact plane, and the second group being arranged to take up an adjustable contact position against the second contact plane, and with a means being arranged to cause a preferably reversible rotary movement of the cylindrical disc shaped member, thereby rotating or turning the load carrying unit as desired in relation to the supporting member.

2. Device according to claim 1, characterised in, that each group of bearing means includes at least three bearing means, extending radially and preferably substantially equally angularly spaced from each other within each group.

3. Device according to claim 1, characterised in, that each bearing means comprises of a roller shaped member, having a substantially cylindrical cross-section.

4. Device according to claim 1, characterised in, that each bearing means comprises of a supporting body, including a substantially flat bearing surface, arranged to take up contact with an adjacently located contact plane.

5. Device according to claim 4, characterised in, that a wear member is detachably attached to the supporting body, and that the surface of the wear member directed away from the supporting body is a substantially flat bearing surface, arranged to take up contact with an adjacently located contact plane.

6. Device according to claim 4, characterised in, that the supporting body is arranged with a logitudinally extending groove, arranged to embrace or seize at least two opposed edge portions of a wear member, or that the wear member is arranged with a groove, arranged to embrace or seize at least two opposed edge portions of the supporting body.

7. Device according to claim 1, characterised in, that the bearing means are arranged attached to a manually operable adjustment means, arranged to apply the bearing means by means of excentric action against each contact plane.

8. Device according to claim 7, characterised in, that the manually operable adjustment means is arranged with a locking or blocking means, arranged to facilitate locking of the adjustment means in desired adjustment position.

9. Device according to claim 1, characterised in, that the device is pivotably attached to the supporting member, and that at least one piston cylinder, preferably hydraulically operated, is arranged to facilitate a pivoting movement of the device, and thus also thereto attached load carrying unit, in a plane different from the plane in which the load carrying unit can perform a rotating or turning movement.

10. Device according to claim 1, characterised in, that the preferably cylindrical disc shaped member comprises of a cog wheel, arranged with peripherally located cogs.

11. Device according to claim 10, characterised in, that the peripherally located cogs are arranged to interconnect with a screw worm, driven by means of a motor having a preferably reversible direction of rotation.

12. Device according to claim 10, characterised in, that the peripherally located cogs are arranged to interconnect with a rack, preferably connected to a hydraulically or pneumaticlly operated piston cylinder.

13. Device according to claim 1, characterised in, that the device includes a first part having an attachment means arranged to facilitate attachment against the supporting member, and a second part, including an attachment means arranged to facilitate attachment against the load carrying unit.

14. Device according to claim 13, characterised in, that the first and the second part of the device are arranged pivotably in relation to each other in a plane different to the plane in which the load carrying unit can be rotated or turned.

* * * * *